US005207406A

United States Patent [19]

Stine et al.

[11] Patent Number: 5,207,406

[45] Date of Patent: May 4, 1993

[54] UMBRELLA STAND

[76] Inventors: Janice M. Stine, 3425 Radcliffe Rd., Thousand Oaks, Calif. 91360; Karen J. Soleri, 1734 Drumcliff Ct., Westlake Village, Calif. 91361

[21] Appl. No.: 848,037

[22] Filed: Mar. 9, 1992

[51] Int. Cl.[5] ..... F16M 13/00

[52] U.S. Cl. ..... 248/514; 135/99; 248/346; 248/519; 248/535; 248/910; 248/912

[58] Field of Search ..... 248/346, 910, 911, 912, 248/514, 535, 518, 519, 520, 512, 513, 517, 523; 135/98, 99, 902

[56] References Cited

U.S. PATENT DOCUMENTS

| | | | |
|---|---|---|---|
| 2,474,725 | 6/1949 | Clark, Jr. | 248/558 X |
| 2,613,899 | 10/1952 | Wagner et al. | 248/346 X |
| 3,119,588 | 1/1964 | Keats | 248/519 X |
| 3,554,473 | 1/1971 | Rakov et al. | 248/910 X |
| 3,900,194 | 8/1975 | Ward et al. | 248/519 X |
| 4,193,572 | 3/1980 | Horiuchi et al. | 248/535 |
| 4,296,693 | 10/1981 | Archer | 248/910 X |
| 4,753,411 | 6/1988 | Lechner et al. | 248/910 X |

FOREIGN PATENT DOCUMENTS

| | | | |
|---|---|---|---|
| 2100328 | 7/1971 | Fed. Rep. of Germany | 248/910 |
| 2450743 | 4/1976 | Fed. Rep. of Germany | 248/910 |
| 670360 | 4/1952 | United Kingdom | 248/910 |

*Primary Examiner*—David L. Talbott
*Attorney, Agent, or Firm*—Jack C. Munro

[57] ABSTRACT

An umbrella stand designed to be used principally in conjunction with a beach umbrella with the stand to be located on sand. The umbrella shaft is to be optionally mounted either in a vertical position or inclined position on the stand. The stand is to include a container to which is to be added a quantity of a weighty substance such as the sand to provide a heavy enough base to prevent tipping over of the umbrella during usage.

4 Claims, 1 Drawing Sheet

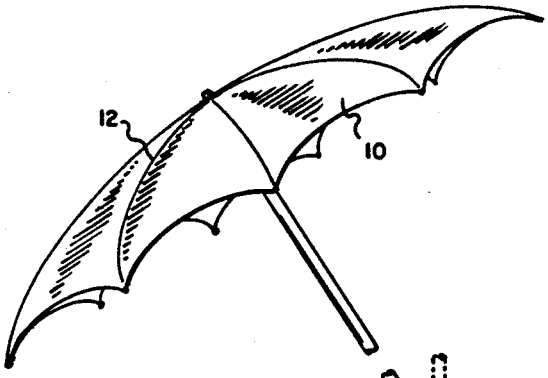
FIG. 1
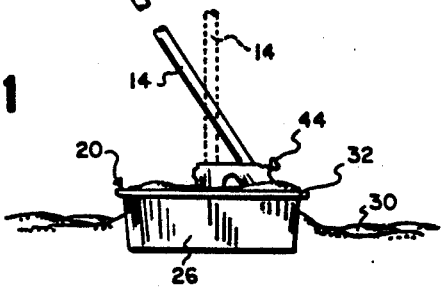
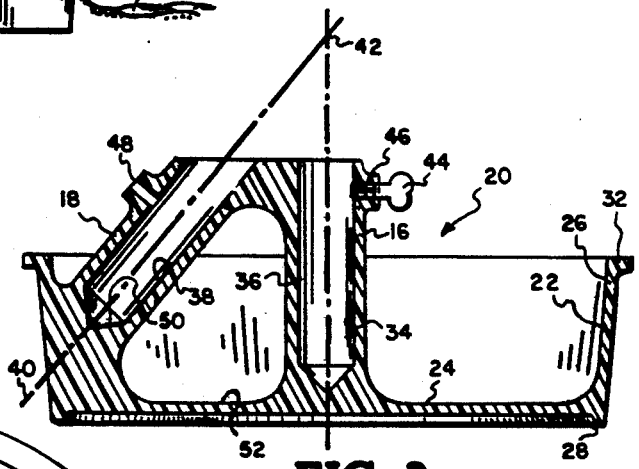
FIG. 2
FIG. 3
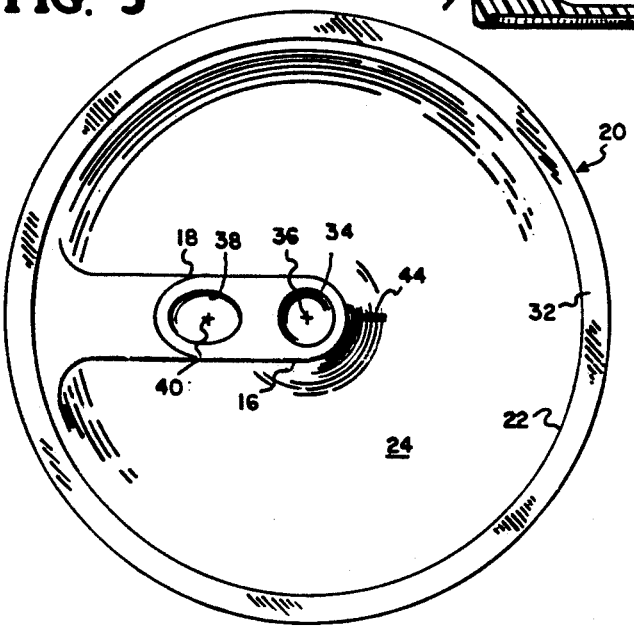

UMBRELLA STAND

BACKGROUND OF THE INVENTION

1) Field of the Invention

The field of this invention relates to stands and more particularly to a stand for an umbrella that is portable and is to be used temporarily in a selected location such as at the beach.

2) Description of Related Art

The use of umbrellas at the beach has long been known. The function of the umbrella is to provide shade to a user preventing over exposure of the sun to the user. Such umbrellas have to be substantially large in size in order to provide adequate shade. A common diameter for the umbrella would be somewhere in the range of six to eight feet.

The umbrella is mounted on an umbrella shaft. It is common to merely embed this umbrella shaft into the sand at a particular location. This embedding requires a certain amount of force in order for the umbrella to stand and many times the potential user is just not strong enough to satisfactorily embed the umbrella shaft. Also, even in slightly windy conditions, it is common for the umbrella to become dislodged from the sand at which time the umbrella now functions as a parachute and can be blown some substantial distance away from its location of usage. Also, the uncontrolled blowing movement of the umbrella is a potential hazard as it can cause injury to other persons let alone damage to the umbrella itself or other structures.

SUMMARY OF THE INVENTION

The structure of the present invention relates to using of a stand which includes a socket arrangement into which the shaft of the umbrella is to be located. The user has an option of locating the umbrella in a substantially vertical position or in an inclined position according to a particular desired usage. When the umbrella shaft is mounted in conjunction with the socket assembly, there is incorporated a thumb screw type of fastener that is to securely fix the position of the shaft of the umbrella to the socket arrangement. The socket arrangement is mounted within a base comprising a container with this container being defined by an enclosing sidewall which is open at the top. A quantity of a weighty substance, such as sand, is to be placed within the container to provide adequate weight for the base to prevent tipping of the umbrella during usage. The exterior of the bottom surface of the base includes an annular flange which is to be embedded into the sand to secure the position of the umbrella stand at its placed location.

BRIEF DESCRIPTION OF THE DRAWING

FIG. 1 is a perspective view of the umbrella stand of the present invention showing an umbrella being mounted in conjunction with the stand in an inclined position;

FIG. 2 is a transverse, cross-sectional view through the umbrella stand of the present invention; and FIG. 3 is a top, plan view of the umbrella stand of the present invention.

DETAILED DESCRIPTION OF THE SHOWN EMBODIMENT

Referring particularly to the drawing, there is shown a conventional umbrella which is formed of a series of panels 10 mounted between a plurality of metal ribs 12. These ribs 12 are mounted on a shaft 14. The ribs 12 and the panels 10 are to be collapsible to a collapsed position which is not shown. The lower end of the umbrella shaft 14 is capable of being located within upright socket 16 or inclined socket 18 of an umbrella stand 20. With the shaft 14 connecting with upright socket 16, the shaft 14 is located in a substantially vertical position. With the shaft 14 located in conjunction with the inclined socket 18, the shaft 14 is located in a substantially inclined position. Typical inclination would be thirty to forty-five degrees from the vertical.

The sockets 16 and 18 are actually to be formed integrally and are both located within an interior chamber 22 of a base formed into a container which is formed by a bottom 24 and an enclosing sidewall 26. Enclosing sidewall 26 is integrally connected to the bottom 24 at its peripheral edge and extends upwardly therefrom forming the interior chamber 22. The exterior surface of the bottom 24 includes an annular flange 28 which is slightly sharpened and is designed to embed into the surface 30 upon which the stand 20 is located. A typical material for the surface 30 would be sand. The upper or free edge of the enclosing sidewall 26 is formed into a short horizontal flange 32. The purpose of the flange 32 is primarily for strength purposes to give rigidity to the enclosing sidewall 26 of the umbrella stand 20.

The upright socket 16 includes a first elongated recess 34. The recess 34 has a longitudinal center axis 36 for which during normal usage of the stand 20 will coincide with the vertical direction. Axis 36 also coincides with the center point of the bottom 24 and the center of the enclosing sidewall 26. The umbrella shaft 14 is to be located within the recess 34 to locate the umbrella shaft 14 in a vertical manner.

When it is desired to locate the umbrella shaft 14 in an inclined position, the shaft 14 is to be located within the second elongated recess 38 of the inclined socket 18. The second elongated recess 38 has longitudinal center axis 40. This axis 40 is to intersect the axis 36 at point 42. Point 42 is located above the open top of the umbrella stand 20 which is clearly shown in FIG. 2 of the drawing.

It is to be noted that the recesses 34 and 38 are of the same length and of the same diameter. However, it is considered to be within the scope of this invention that the length of the recesses 34 and 38 could be varied and could be different. Also, the physical diameters of the recesses 34 and 38 could be different. However, normally the diameter of the recesses 34 and 38 would be just made slightly larger than the largest known diameter of umbrella shaft 14. Therefore, the stand 20 of this invention is to accommodate to all known sizes of umbrella shafts.

When the shaft 14 of an umbrella is mounted within the recess 34, such can be securely fixed in position by manual operation of a thumb screw 44 which is screw threadingly engaged within a threaded opening 46 located within the upright socket 16. Thumb screw 44 can be disengaged from the threaded hole 46 and engage with a similar threaded hole 48 formed within the wall of the inclined socket 18. In this particular position, the thumb screw 44 will then connect with the umbrella shaft 14 when it is located within a second elongated recess 38. It is also considered to be within the scope of this invention that there may be utilized two separate thumb screws 44 with one being permanently located within threaded hole 46 and the other being permanently located within the threaded hole 48.

It is necessary to provide physical weight in conjunction with the umbrella stand 20 in order to keep the umbrella from tipping over. In order to achieve this end, the interior chamber 22 is to be substantially filled with sand or other similar type of weighty substance.

It is important to have the recess 38 located so that the bottommost edge of the umbrella shaft 14 be located directly adjacent the enclosing sidewall 22. This so locating of the recess 38 is so as to make it more difficult for the umbrella to tip over. If perchance the bottom end 50 of the recess 38 was located directly adjacent the upright socket 16, upon an umbrella shaft 14 being located within the recess 38, there would be inherently created a torque due to the weight of the umbrella tending to tip such over. This tipping over can be diminished by the so locating of the inclined socket 18 in the position shown in FIG. 3 of the drawing.

Separating the socket 16 and 18 is an enlarged opening 52. It is the function of the opening 52 to lighten the weight of the stand 20.

What is claimed is:

1. An umbrella stand comprising:

a base formed into a container, said container having a bottom to which is attached a peripheral edge at the periphery of said bottom, said bottom having a center point, an enclosing sidewall attached to said peripheral edge, said enclosing sidewall defining an interior chamber, said container having an open top located at the free edge of said enclosing sidewall, said container being capable of retaining a quantity of a separate weighty substance such as sand; and a socket arrangement mounted on said bottom and located within said interior chamber, said socket arrangement including an upright socket and an inclined socket, said upright socket having a first elongated recess adapted to receive an umbrella shaft, said inclined socket having a second elongated recess adapted to receive an umbrella shaft, said first elongated recess having a first longitudinal center axis, said second elongated recess having a second longitudinal center axis, said second longitudinal center axis intersecting said first longitudinal center axis at a point located above said open top, said first longitudinal center axis coinciding with said center point, said second longitudinal recess terminating in a bottom end, said bottom end being located directly adjacent said enclosing sidewall, said inclined socket being located between said enclosing sidewall and said first longitudinal center axis.

2. The umbrella stand as defined in claim 1 wherein:

said socket arrangement includes fasteners, said fasteners to be movable between an unlocked position and a locked position, said fasteners being adapted to be used to fix the umbrella shaft to said socket arrangement when in said locked position.

3. The umbrella stand as defined in claim 1 wherein:

said first elongated recess being the same length as said second elongated recess.

4. The umbrella stand as defined in claim 1 including:

an annular flange mounted on the exterior surface of said base, said annular flange to facilitate secure retention of said umbrella stand on the surface to which it is located by said annular flange embedding within this surface.

* * * * *